US006896574B2

(12) United States Patent
Needham et al.

(10) Patent No.: US 6,896,574 B2
(45) Date of Patent: May 24, 2005

(54) MAGNETICALLY COUPLED TOY VEHICLES

(75) Inventors: Andrew Needham, Bollington (GB); Adam Tooby, Northwich (GB); Julian Richard Payne, Delran, NJ (US); Francis Ponton, Jr., Marlton, NJ (US); Gregory John Sisolak, Mt. Laurel, NJ (US); Robert Alan Butkiewicz, Shamong, NJ (US); Anthony Peter Monzo, Medford, NJ (US)

(73) Assignee: Mattel, Inc., El Segundo, CA (US)

( * ) Notice: Subject to any disclaimer, the term of this patent is extended or adjusted under 35 U.S.C. 154(b) by 51 days.

(21) Appl. No.: 10/418,814

(22) Filed: Apr. 18, 2003

(65) Prior Publication Data

US 2004/0023593 A1 Feb. 5, 2004

Related U.S. Application Data

(60) Provisional application No. 60/447,672, filed on Feb. 14, 2003, provisional application No. 60/423,310, filed on Nov. 1, 2002, and provisional application No. 60/385,158, filed on May 30, 2002.

(51) Int. Cl.[7] ..... A63H 33/26
(52) U.S. Cl. ..... 446/138; 446/129
(58) Field of Search ..... 446/129, 138, 446/92, 131; 213/75 D, 75 TC; 24/303; 403/DIG. 1

(56) References Cited

U.S. PATENT DOCUMENTS

| | | | | | |
|---|---|---|---|---|---|
| 2,645,878 | A | | 7/1953 | Johnson | |
| 2,677,214 | A | | 5/1954 | Herman | |
| 3,330,066 | A | * | 7/1967 | Crawford | 446/138 |
| 3,864,872 | A | | 2/1975 | Hoetzel | |
| 3,883,988 | A | | 5/1975 | Fields | |
| 4,068,403 | A | | 1/1978 | Weiser | |
| 4,516,948 | A | | 5/1985 | Obara | |
| 4,762,511 | A | | 8/1988 | Lee et al. | |
| 4,878,869 | A | | 11/1989 | Yamane et al. | |
| 4,940,442 | A | | 7/1990 | Matsuda | |
| 5,048,704 | A | | 9/1991 | Takahashi | |
| 5,427,561 | A | * | 6/1995 | Eichhorn et al. | 446/463 |
| 5,681,202 | A | * | 10/1997 | Sander | 446/138 |
| 5,813,894 | A | | 9/1998 | Tohyama | |
| 5,820,441 | A | | 10/1998 | Pracas | |
| 5,895,189 | A | * | 4/1999 | Ruckert | 403/DIG. 1 |
| 6,101,688 | A | * | 8/2000 | Marchesi | 24/303 |
| 6,106,361 | A | | 8/2000 | Petris | |
| 6,352,463 | B2 | * | 3/2002 | Forkman | 446/138 |
| 6,379,213 | B2 | * | 4/2002 | Whitworth | 446/444 |

* cited by examiner

*Primary Examiner*—Jacob K. Ackun
*Assistant Examiner*—Faye Francis
(74) *Attorney, Agent, or Firm*—Akin Gump Strauss Hauer & Feld, L.L.P.

(57) ABSTRACT

A magnetic coupling for toy vehicles includes a stationary protruding member and a retractable member, each having a rounded end piece. One of the end pieces is at least partially formed of a magnetic material and the other is at least partially formed of a non-magnetic, magnetically attractive material. A separate end piece can be provided on each of a pair of toy vehicles or each vehicle can be provided with both. The retractable member can be configured to receive the protruding member in a mechanical coupling.

17 Claims, 6 Drawing Sheets

MAGNETICALLY COUPLED TOY VEHICLES

CROSS-REFERENCE TO RELATED APPLICATIONS

This application claims the benefit of U.S. Provisional Application Nos. 60/385,158 filed May 30, 2002, No. 60/423,310, filed Nov. 1, 2002, and No. 60/447,672 filed Feb. 14, 2003, all entitled "Magnetically Coupled Toy Vehicles", the entire contents of which are incorporated by reference herein.

BACKGROUND OF THE INVENTION

The present invention relates generally to coupling devices for toy vehicles, such as toy cars, toy trucks, toy boats, toy trains, toy helicopters or the like and, more particularly, to a magnetic coupling including a stationary member and a retractable member.

Toy trains and other vehicles that join together to be towed or pulled in play are well known. Many toy trains utilize clasps or clevis-type hitches to join the train cars together. The clevis-type hitches allow a range of motion, but they generally require the user to pull a lever or spring-loaded upper piece in order to open the clevis portion to separate the train cars. Additionally, the hitch arrangements are all for allowing a tow action.

Some toy vehicle sets have utilized magnets to join together individual vehicles. Generally the vehicles have a magnet at either end. Each magnet is nearly identical so the magnets must be able to rotate or move in some fashion in order to align with the opposite poles (North/South) of another vehicle's magnet. Some of these vehicles had joined the magnets to the vehicles by chains or strings which allowed articulation similar to a hitch when pulling the vehicles, but does not allow for pushing the vehicles or pulling multiple vehicles as one composite unit more like a bus than a train or trailer.

What is needed but not provided for in the prior art is a coupling that allows a user to merely touch the ends of two vehicles together to join them and that allows a user to pull the vehicles without decoupling and to separate the vehicles by applying more force. What is also needed and not provided by the prior art is a composite vehicle made up of multiple vehicles that have similar coupling members capable of towing the multiple vehicles like a train in one configuration or pushing and pulling the multiple vehicles like one larger non-articulating vehicle in another configuration.

BRIEF SUMMARY OF THE INVENTION

Briefly stated, in one aspect the present invention is a magnetic coupling for toy vehicles. The magnetic coupling comprises a stationary protruding member having an engageable ridge and a dome-shaped end piece and a retractable member having a dome-shaped end piece for engaging the dome-shaped end piece of the stationary protruding member. One of the two dome-shaped end pieces is at least partially formed of a magnetic material and the other of the two dome-shaped end pieces is at least partially formed of a non-magnetic, magnetically attractive material.

In another aspect, the present invention is also a coupling device for a toy vehicle. The coupling device comprises a stationary protruding member having a circumferentially extending engageable ridge and a free end with a first end piece and a retractable member having a second end piece configured to releasably engage with the first end piece of the stationary protruding member. The retractable member includes an outer sleeve with a central bore sized to receive the free end of the stationary protruding member and a plurality of resilient fingers to releasably engage with the engageable ridge of the stationary member. The retractable member also includes a stalk in the central bore in sliding relationship within the outer sleeve. The stalk has a shoulder, a proximal end, a distal end, an extended position and a retracted position. The dome-shaped end piece is located at the proximal end of the stalk. The retractable member further includes a spring located at least partially within the outer sleeve proximate the distal end of the stalk so as to bias the stalk outwardly.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
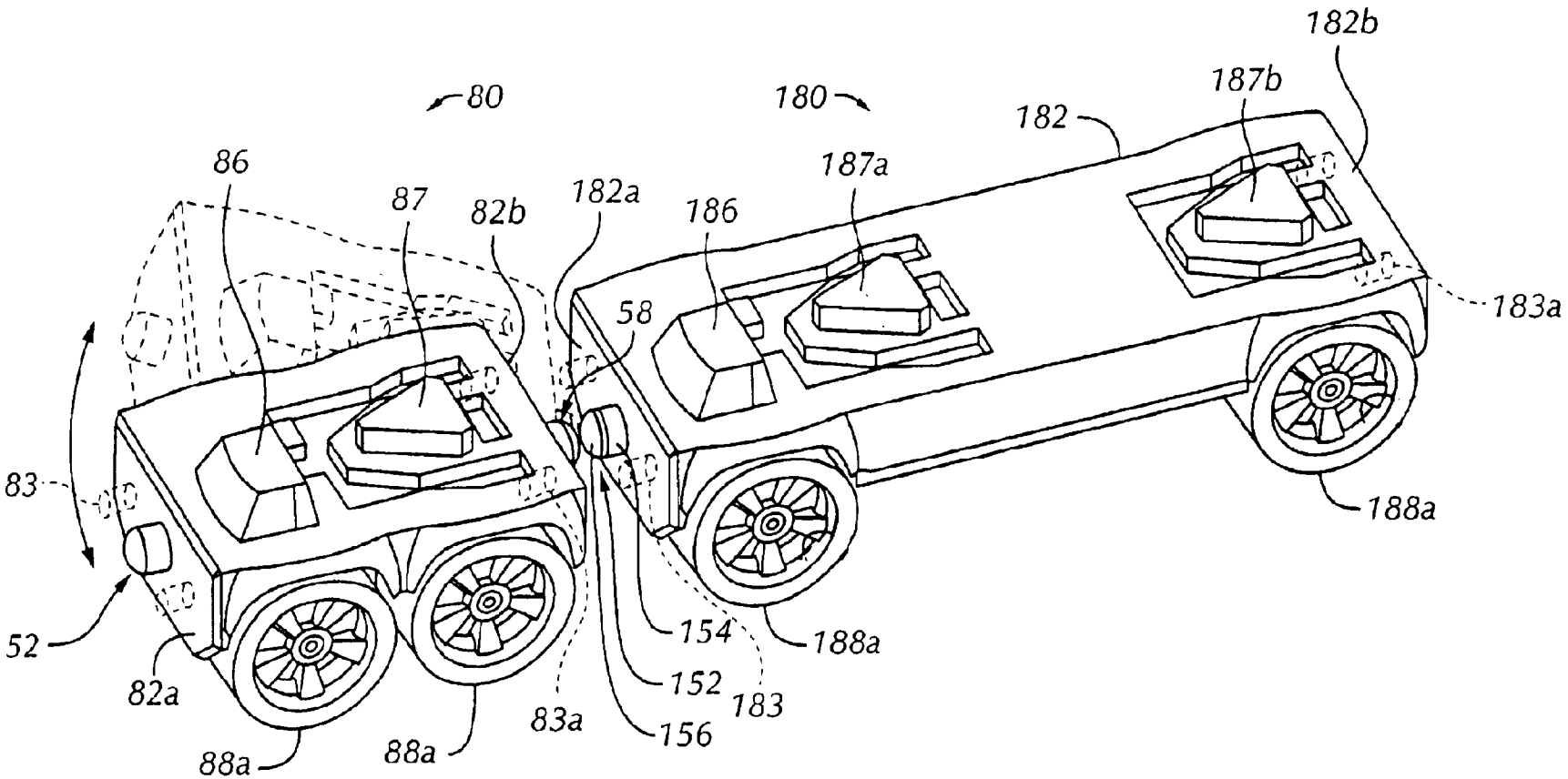
FIG. 1 is a side elevational view of a composite vehicle formed of two component vehicles with a magnetic coupling in an extended position in accordance with the preferred embodiments of the present invention.
Figure 2:
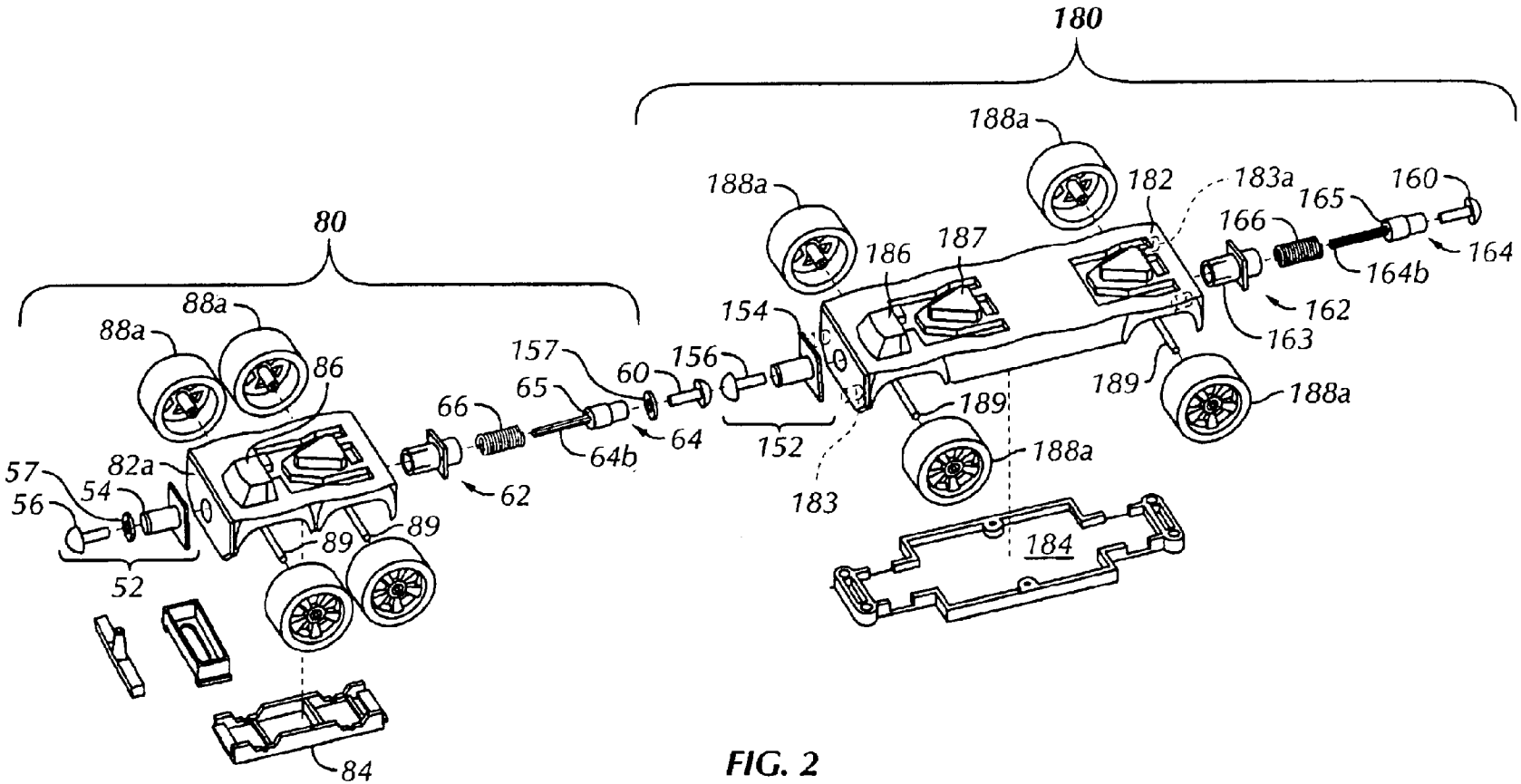
FIG. 2 is an exploded view of the composite vehicle of FIG. 1.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the object discussed and designated parts thereof. The terminology includes the words above specifically mentioned, derivatives thereof and words of similar import. Additionally, the word "a" as used in the claims and in the corresponding portions of the specification, means "one or more than one".

In the drawings, like numerals are used to indicate like elements throughout. Referring to the drawings in detail, there is shown in FIGS. 1–5 a magnetic coupling for toy vehicles in accordance with a preferred embodiment of the present invention.

FIGS. 1–5 show elements of the preferred magnetic coupling 50 for toy vehicles. The magnetic coupling 50 includes a stationary protruding member 52 having an engageable ridge in the form of protruding circumferential rim or ring 54, a free end 52*a* and a dome-shaped end piece 56. The magnetic coupling 50 also includes a retractable member 58 having a dome-shaped end piece 60 for engaging the dome-shaped end piece 56 of the stationary protruding member 52. One of the two dome-shaped end pieces 56, 60 is at least partially formed of a magnetic material and the other of the two dome-shaped end pieces 56, 60 is at least partially formed of a non-magnetic, magnetically attractive material. Preferably, the dome-shaped end pieces 56, 60 are substantially formed of polished, carbon steel. But, the dome-shaped end pieces 56, 60 may be formed of other magnetically attractive materials such as iron, nickel, cobalt, metal alloys and the like without departing from the present invention. The one of the first and second end pieces 56 or 60 that is at least partially formed of the magnetic material preferably includes an interior chamber (not shown) for housing the magnetic material. The magnetic material is preferably encased in magnetically attractive metal which forms the dome-shaped end-piece as described above. The magnetically attractive metal is preferably capable of being magnetized by the internal magnetic material. The internal magnetic material may be lodestone (a naturally magnetic iron ore), iron, nickel, cobalt, carbon steel, ferroceramics, Alnico (an alloy containing iron, aluminum, nickel, cobalt, and copper) and the like. In one configuration, the magnetically attractive material is formed as a ring washer 57 which is positioned behind the applicable dome-shaped end-piece 56 or 60.

The retractable member 58 further includes an outer sleeve 62 having a plurality of resilient fingers 63 for engagement with the engageable ridge 54 of the stationary member 52. The outer sleeve 62 defines a central bore 67 sized to receive the free end 52*a* of the stationary protruding member 52. The retractable member 58 also includes a stalk 64 in sliding relationship with the outer sleeve 62 having a proximal end 64*a* and a distal end 64*b*. The retractable member 58 is seen in an extended position in FIGS. 1 and 3 and a retracted position in FIG. 4. The dome-shaped end piece 60 is affixed to the proximal end 64*a* of the stalk 64. The retractable member 58 further includes a spring 66 located partially within the outer sleeve 62 proximate the distal end 64*b* of the stalk 64 which biases the stalk 64 outwardly (in the proximal direction). The spring 66 is retained between the shoulder 65 of stalk 64 and a wall of a vehicle (see FIGS. 2–5). Preferably, the spring 66 is a steel coil-type spring.

Preferably, the outer sleeve 62, the stationary member 52 and the stalk 64 are formed of a molded, polymeric material. But, the outer sleeve 62, the stationary member 52 and the stalk 64 may be formed of other materials such as wood, metal, ceramics and the like without departing from the present invention.

Figure 3:
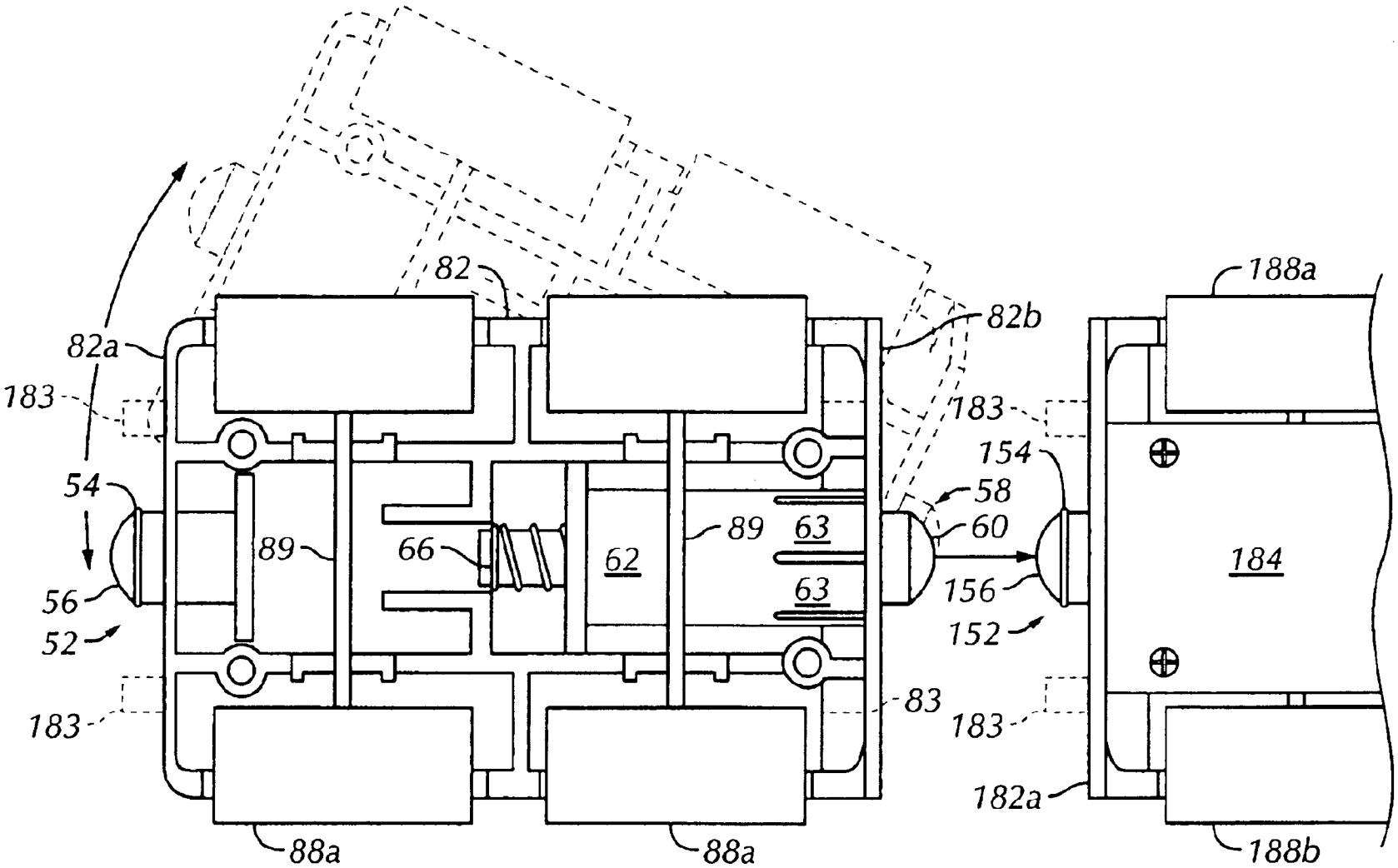
FIG. 3 is an enlarged bottom plan view of the composite vehicle of FIG. 1 with the magnetic coupling of one component vehicle in the extended position.
Figure 4:
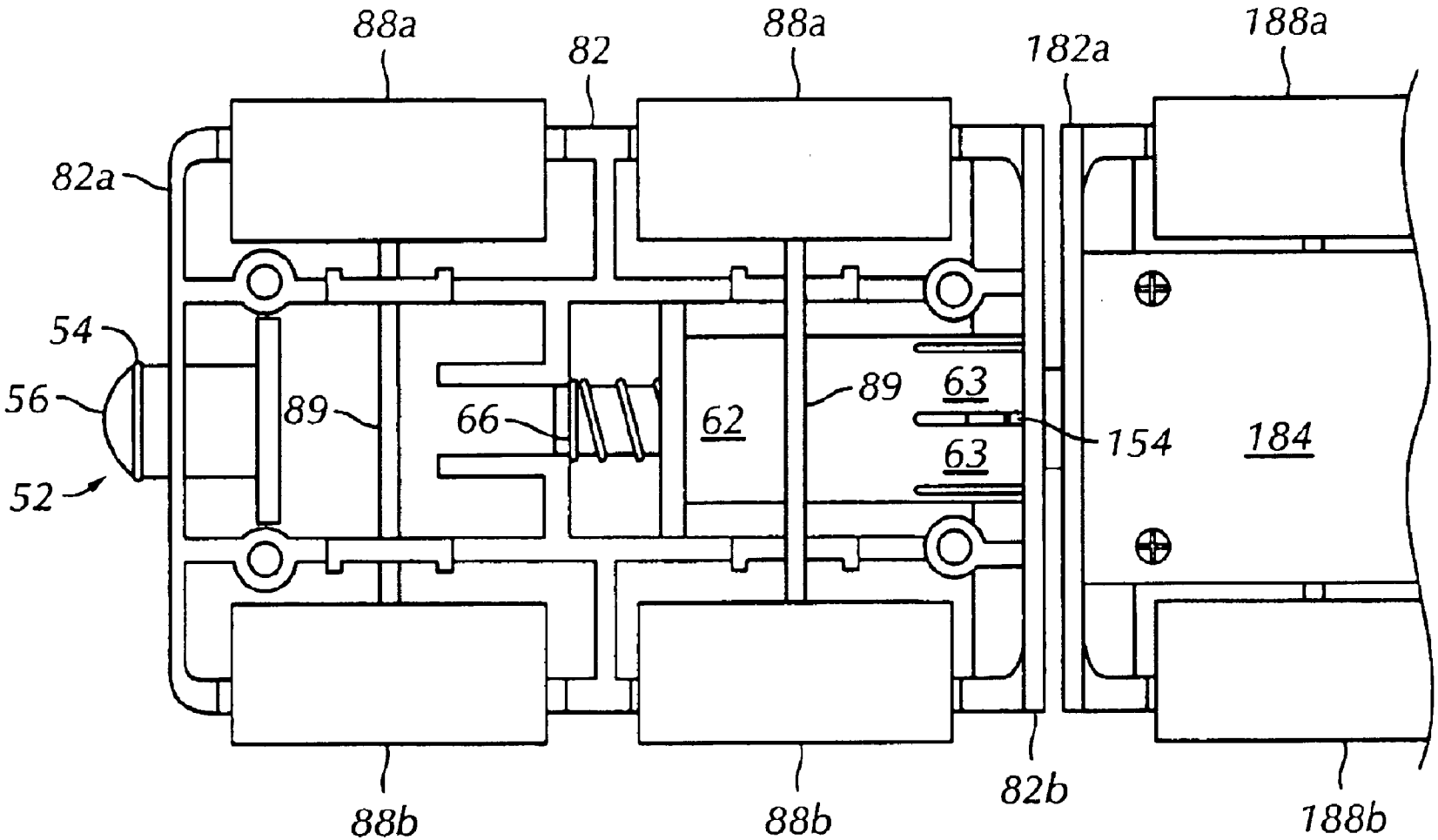
FIG. 4 is an enlarged bottom plan view of one end of the composite vehicle of FIG. 1 with the magnetic coupling of the one component vehicle in a retracted position.
Figure 5:
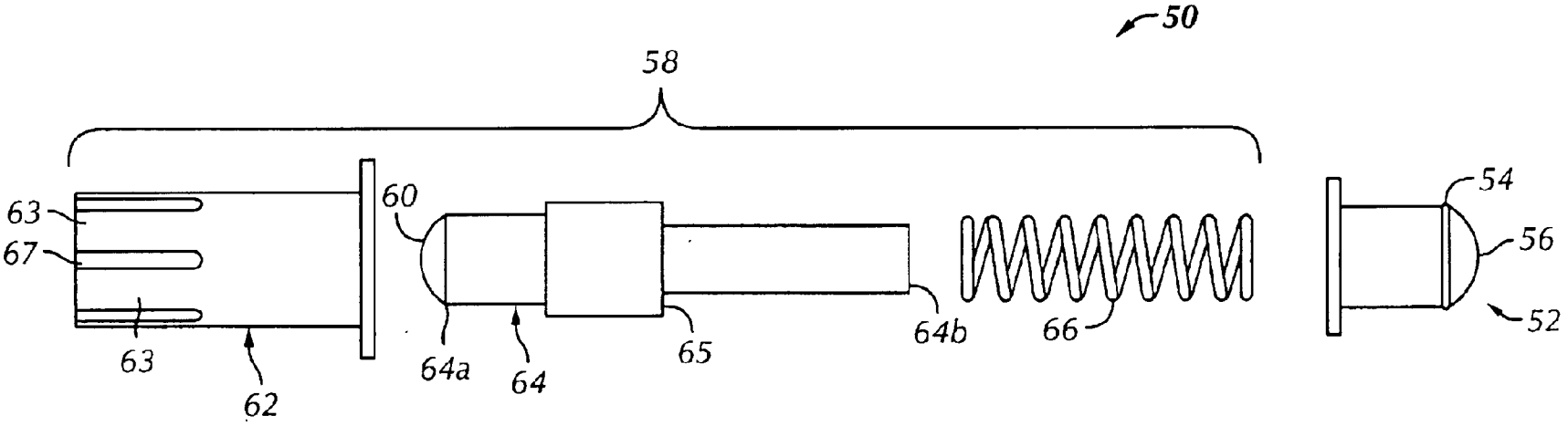
FIG. 5 is an enlarged plan view of a stationary coupling and a retractable coupling of FIG. 1 having the retractable coupling partially disassembled.

In use, the magnetic coupling 50 allows operation with the retractable member 58 in either the extended position or the retracted position. When the stationary protruding member 52 engages the retractable member 58 and the retractable member 58 remains in the extended position, the stationary protruding member 52 will remain connected to the retractable member 58 by magnetic attraction only (FIGS. 1 and 3). When the stationary protruding member 52 engages the retractable member 58 and the retractable member 58 moves to the retracted position by the force of a user, the stationary protruding member 52 is retained at least partially within the outer sleeve 62 by the biasing force of the plurality of resilient fingers 63 on the engageable ridge 54 (FIG. 4).

While an individual stationary member 52 and a separate retractable member 58 might be used singly, preferably both coupling components 52, 58 are provided on each of a plurality of component vehicles. For example, the magnetic coupling 50 can be used in combination with a first component toy vehicle 80 preferably having a bottom cover 84 and a body 82 with a first end 82*a* and a second opposing end 82*b*. The stationary member 52 is located proximate the first end 82*a* of the body 82 which is preferably the front end. The retractable member 58 is located proximate the second end 82*b* of the body 82 which is preferably the rear end. But, the stationary member 52 could be located proximate the second/rear end 82*b* of the body and the retractable member 58 could be located proximate the first/front end 82*a* of the body without departing from the present invention.

The first toy vehicle 80 has the overall shape of a truck chassis including an integrally molded cab 86 located proximate the first end 82*a*, an integrally molded connector 87, and wheels 88*a*. The wheels 88*a* rotate freely on axles 89. In the presently preferred embodiment, the first vehicle 80 is not powered by motors, springs or gears. However, it is contemplated that the first vehicle 80 further includes a motor and battery or spring for powering at least one drive wheel.

Preferably, the body 82, bottom cover 84 and wheels 88*a*, are formed of a molded polymeric material. But, the body 82, bottom cover 84 and wheels 88*a*, may be formed in other fashions such as etching, carving and the like and of other materials such as wood, metal, ceramic and the like. The body 82, bottom cover 84 and wheels 88*a*, preferably include carved or molded details such as treads, windows, flares and the like to give the first vehicle 80 a more realistic look.

Optionally, the first toy vehicle 80 includes stability posts 83 protruding from one end of the vehicle 80 and mating sockets 83*a* at the other end of the vehicle 80. The receiving sockets 83*a* are generally aligned with the stability posts 83 in order that the stability posts 83 of one vehicle 80 can align and mate with the receiving sockets 83*a* of another vehicle 80 when close coupled. The stability posts 83 prevent the vehicles 80 from rotating when close coupled.

Another or second component toy vehicle 180 has a body 182 with a first end 182*a* and a second opposing end 182*b*. The second toy vehicle 180 is used in combination with a second magnetic coupling 150 identical to magnetic coupling 50. The second magnetic coupling 150 includes a second stationary protruding member 152 identical to 52 having an engageable ridge 154 and a dome-shaped end piece 156. The second magnetic coupling 150 of vehicle 180 also includes a second retractable member 158 identical to member 58 having a shoulder 155 and a dome-shaped end piece 160 for engaging the dome-shaped end pieces of other stationary protruding members. The second magnetic coupling 150 further includes an outer sleeve identical to 62 having a plurality of resilient fingers identical to 63 for engagement with an engageable ridge of another stationary protruding member of another toy vehicle. This second retractable member includes a stalk 164 in sliding relationship within the outer sleeve and having a proximal end 164*a*, an opposing distal end, an extended position and a retracted position. The dome-shaped end piece 160 is affixed to the proximal end 164*a* of the stalk 164. The second retractable member further includes a spring identical to 66 located partially within the outer sleeve proximate the distal end of the stalk 164, so as to bias the stalk 164 outwardly from the body 182 of the second toy vehicle 180. Similarly to the first toy vehicle 80, the magnetic coupling 150 of the second toy vehicle 180 has a magnetically attractive material disposed in or behind at least one of the first and second dome-shaped end-pieces 156, 160, such as a ring washer 157.

The second toy vehicle 180 has the overall shape of a truck chassis including an integrally molded cab 186 proximate the first/front end 182*a*, integrally molded connectors 187*a*, 187*b*, and wheels 188*a*. The wheels 188*a* rotate freely on axles 189. In the presently preferred embodiment, the second vehicle 180 is not powered by motors, springs or gears. However, it is contemplated that the second vehicle 180 further includes a motor and battery or spring for powering at least one drive wheel.

Preferably, the body 182, bottom cover 184 and wheels 188*a*, are formed of a molded polymeric material. But, the body 182, bottom cover 184 and wheels 188*a*, may be formed in other fashions such as etching, carving and the like and of other materials such as wood, metal, ceramic and the like. The body 182, bottom cover 184 and wheels 188*a* preferably include carved or molded details such as gages, tanks, fans, treads, windows, flares and the like to give the second vehicle 180 a more realistic look. The second vehicle 180 possesses similar attributes regarding materials of construction and appearance as compared to the first vehicle 80, but preferably, the second vehicle 180 is about as twice as long as the first vehicle 80 so that it can mate side to side with first vehicle 80 and another vehicle 80 fixedly mated together end 82 to end 82*a*.

Optionally, the second vehicle 180 includes stability posts 183 protruding from one end of the vehicle 180 and mating sockets 183*a* at the other end of the vehicle 180. The receiving sockets 183*a* are generally aligned with the stability posts 183 in order that the stability posts 183 of one vehicle 180 can align and mate with the receiving sockets 183*a* of another vehicle 180 when close coupled. Further, the receiving sockets 183*a* are preferably spaced and aligned to mate with the stability posts 83 of the first toy vehicle 80 and vice versa. The stability posts 183 prevent the vehicles 80, 180 from rotating when close coupled.

When the first and second toy vehicles 80, 180 are used in combination, they form another composite toy vehicle 20 which can be configured to couple only magnetically or through a more closely adjoined mechanical union as will be described hereinafter.

FIGS. 1 and 3 shows that when the stationary protruding member 152 of the second vehicle 180 magnetically engages the retractable member 58 of the first vehicle 80 and the retractable member 80 remains in the extended position, the stationary protruding member 152 of the second toy vehicle 180 remains releasably connected to the retractable member 52 of the first toy vehicle 80 by magnetic attraction. The magnetic attraction force is sufficiently strong to allow the first toy vehicle 80 to be pulled during play by a user without releasing the second toy vehicle 180; however, the magnetic attraction force is sufficiently limited to allow the user to separate the first toy vehicle 80 from the second toy vehicle 180 with more force.

Because the end pieces 56, 60 are dome-shaped, the first and second vehicles 80, 180 can articulate as they are able to pivot through arcs of about 180° (i.e., up to 90° in any direction from a coaxial position with one another) while remaining magnetically coupled (phantom lines in FIGS. 1 and 3). Thus, a user may link either vehicle 80, 180 to the other vehicle 80, 180 with the retractable member 58 of the first vehicle 80 in the extended position and use either vehicle 80, 180 to pull or tow the other vehicle 80, 180 like an articulated trailer-type of composite vehicle 20.

FIG. 4 shows that when the second protruding member 152 of the second toy vehicle 180 engages the retractable member 58 of the first toy vehicle 80 and the retractable member 58 moves to the retracted position by the force of a user, the stationary protruding member 152 of the second toy vehicle 180 is releasably retained at least partially within the outer sleeve 62 of the retractable member 58 of the first toy vehicle 80 by the biasing force of the plurality of resilient fingers 63 on the engageable ridge 154 on the stationary protruding member 152 of the second toy vehicle 180. As the second stationary protruding member 152 is pushed against the dome-shaped end piece 60 of the first vehicle 80, the stalk 64 retracts toward the distal end 62*b* against the biasing force of the spring 66 until the stalk 64 reaches the fully retracted position. The engageable ridge 154 of the second protruding member 152 is slightly larger in diameter than the inner diameter of the central bore 67. As the engageable ridge 154 is pressed inwardly, the resilient fingers 63 are forced outward from the center of the outer sleeve 62. The resilient fingers 63 are biased by their own resiliency to return to the cylindrical shape of the outer sleeve 62 against the mechanical force of the engageable ridge 154. Thus, the second protruding member 154 is retained within the outer sleeve by both the magnetic attraction of the dome-shaped end pieces 60, 158 and by the frictional and resilient biasing forces of the plurality of resilient fingers 63 against the engageable ridge 154. FIG. 4 shows the retractable member 58 in the retracted position where the second stationary protruding member 152 of the second vehicle has pushed the stalk 64 of the retractable member 62 inwardly against the resiliency of the spring 66. When the first and second toy vehicles 80, 180 are combined with one of the retractable members 58, 158 retracted, they form another larger non-articulating-type of composite vehicle 20'. FIG. 3 shows the retractable member 58 in the extended position where the second stationary protruding member 152 has been removed and the bias of the spring 66 has acted to move the stalk 64 outwardly from the body 82 of the first vehicle 180.

Figure 6A:
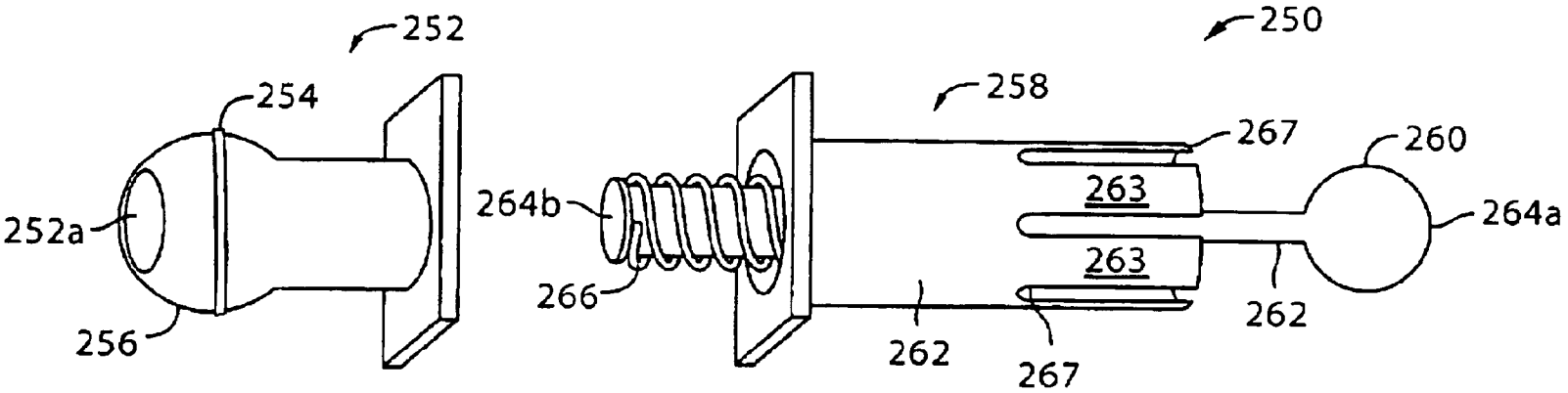
FIG. 6A is a bottom plan view of a coupling in accordance with an alternate embodiment of the present invention.
Figure 6B:
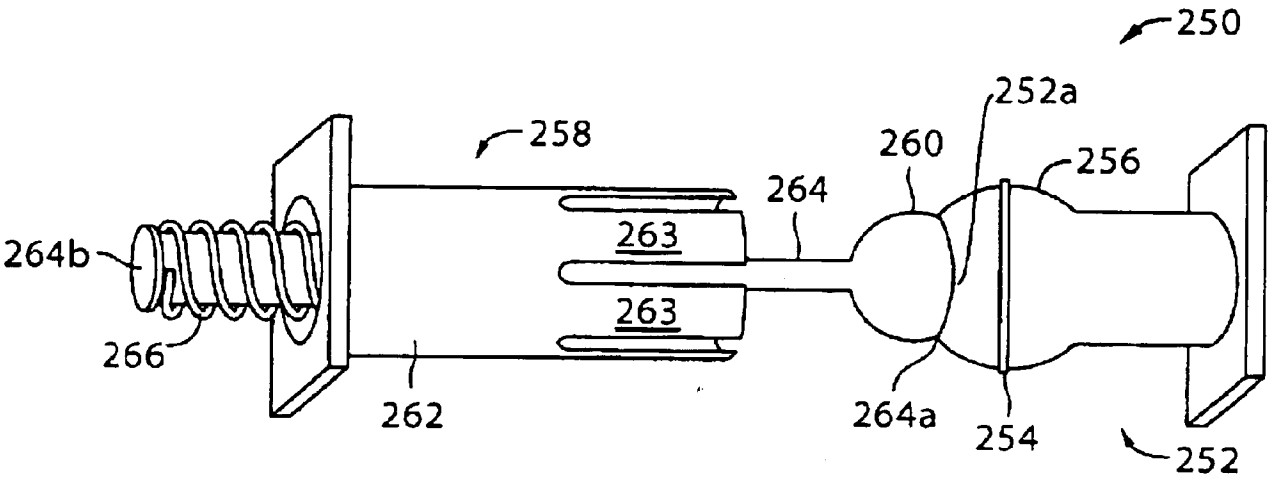
FIG. 6B is a bottom plan view of the coupling member of FIG. 6A partially connected.

In an alternate embodiment shown in FIGS. 6A and 6B, the magnetic coupling is simply a coupling device 250 for a toy vehicle 80 or 180 (shown in phantom). The coupling device 250 includes a stationary protruding member 252 having a circumferentially extending engageable ridge 254 and a free end 252*a* with a first end piece 256. The coupling device 250 also includes a retractable member 258 having a second end piece 260 configured to releasably engage with the first end piece 256 of the stationary protruding member 252. The retractable member 258 includes an outer sleeve 262 defining a central bore 267 sized to receive the free end 252*a* of the stationary protruding member 252 and a plurality of resilient fingers 263 to releasably engage with the engageable ridge 254 of the stationary member 252. The retractable member 258 also includes a stalk 264 in the central bore 267 in sliding relationship within the outer sleeve 262. The stalk 264 has a shoulder 265, a proximal end 264*a*, a distal end 264*b*, an extended position shown in the Figures and a retracted position (not shown). The second end piece 260 is located at the proximal end 264*a* of the stalk 264. The retractable member 258 also includes a spring 266 located at least partially within the outer sleeve 262 proximate the distal end 264*b* of the stalk 264 so as to bias the stalk 264 outwardly. Preferably, the coupling device 250 is used in combination with the first toy vehicle 80 as described in detail above.

FIG. 6B shows a combination of coupling components forming a second coupling device 250' of an essentially identical type to join the first toy vehicle 80 with the second toy vehicle 80 by engagement with one of the stationary protruding member 252 and the retractable member 258 of the first toy vehicle 80. When the stationary protruding member 252 of the second toy vehicle 180 engages the retractable member 258, the retractable member 258 remains in the extended position, and the stationary protruding member 252 of the second toy vehicle 180 remains releasably connected to the retractable member 258 by a mechanical engagement force. The mechanical engagement force is sufficiently strong to allow the first toy vehicle 80 to be pulled during play by a user without releasing the second toy vehicle 180 and the mechanical engagement force is sufficiently limited to allow the user to separate the first toy vehicle 80 from the second toy vehicle 180 with more force.

FIGS. 6A–6B show that the first end piece 256 is a socket and the second end piece 260 is a ball, but the first end piece 256 could also be a ball and the second end piece 260 could be a socket. Further, the first end piece and the second end piece 256, 260 could be other suitable attachment mechanisms without departing from the broad scope of the present invention.

From the foregoing it can be seen that the present invention comprises coupling devices for toy vehicles and a magnetic coupling for toy vehicles. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A magnetic coupling for toy vehicles, the magnetic coupling comprising:

a stationary protruding member having an engageable ridge and a dome-shaped end piece; and a retractable member having a dome-shaped end piece for engaging the dome-shaped end piece of the stationary protruding member, wherein one of the two dome-shaped end pieces is at least partially formed of a magnetic material and the other of the two dome-shaped end pieces is at least partially formed of a non-magnetic, magnetically attractive material.

2. The magnetic coupling according to claim 1 in combination with:

a first toy vehicle having a first end and a second opposing end; and wherein the engageable ridge of the stationary member is located proximate the first end of the vehicle and the retractable member is located proximate the second end of the vehicle.

3. A first toy vehicle with magnetic coupling-comprising:

a stationary protruding member having an engageable ridge and a dome-shaped end piece, the engageable ridge being located proximal a first end of the first toy vehicle;

a retractable member having a dome-shaped end piece for engaging the dome-shaped end piece of the stationary protruding member, the retractable member being located proximal a second, opposing end of the first toy vehicle; and an outer sleeve having a plurality of resilient fingers for engagement with an engageable ridge of a stationary protruding member of another toy vehicle, the outer sleeve being affixed to the first toy vehicle at the second end of the first toy vehicle;

wherein one of the two dome-shaped end pieces is at least partially formed of a magnetic material and the other of the two dome-shaped end pieces is at least partially formed of a non-magnetic, magnetically attractive material;

wherein the retractable member comprises a stalk in sliding relationship within the outer sleeve having a proximal end, a distal end, an extended position and a retracted position, the dome-shaped end piece being affixed to the proximal end of the stalk; and wherein the first toy vehicle further comprises a spring located partially within the outer sleeve proximate the distal end of the stalk so as to bias the stalk outwardly from the vehicle.

4. A combination of a first toy vehicle and a second toy vehicle, each toy vehicle having a coupling device comprising:

a stationary protruding member having an engageable ridge and a dome-shaped end piece, the engageable ridge being located proximal a first end of each toy vehicle;

a retractable member having a dome-shaped end piece for engaging the dome-shaped end piece of the stationary protruding member, the retractable member being located proximal a second, opposing end of each toy vehicle; and an outer sleeve having a plurality of resilient fingers for engagement with an engageable ridge of a stationary protruding member of another toy vehicle, the outer sleeve being affixed to each toy vehicle at the second end of each toy vehicle;

wherein one of the two dome-shaped end pieces is at least partially formed of a magnetic material and the other of the two dome-shaped end pieces is at least partially formed of a non-magnetic, magnetically attractive material;

wherein the retractable member comprises a stalk in sliding relationship within the outer sleeve having a proximal end, a distal end, an extended position and a retracted position, the dome-shaped end piece being affixed to the proximal end of the stalk;

wherein each toy vehicle further comprises a spring located partially within the outer sleeve proximate the distal end of the stalk so as to bias the stalk outwardly from each toy vehicle; and wherein the stationary protruding member of the second toy vehicle engages the retractable member of the first toy vehicle, wherein the retractable member of the first toy vehicle remains in the extended position, and the stationary protruding member of the second toy vehicle remains releasably connected to the retractable member of the first toy vehicle by magnetic attraction.

5. The first toy vehicle and second toy vehicle combination according to claim 4, wherein the magnetic attraction force is sufficiently strong to allow the first toy vehicle to be pulled during play by a user without releasing the second toy vehicle and the magnetic attraction force is sufficiently limited to allow the user to separate the first toy vehicle from the second toy vehicle with more force.

6. A combination of a first toy vehicle and a second toy vehicle, each toy vehicle having a coupling device comprising:

a stationary protruding member having an engageable ridge and a dome-shaped end piece, the engageable ridge being located proximal a first end of each toy vehicle;

a retractable member having a dome-shaped end piece for engaging the dome-shaped end piece of the stationary protruding member, the retractable member being located proximal a second, opposing end of each toy vehicle; and an outer sleeve having a plurality of resilient fingers for engagement with an engageable ridge of a stationary protruding member of another toy vehicle, the outer sleeve being affixed to each toy vehicle at the second end of each toy vehicle;

wherein one of the two dome-shaped end pieces is at least partially formed of a magnetic material and the other of the two dome-shaped end pieces is at least partially formed of a non-magnetic, magnetically attractive material;

wherein the retractable member comprises a stalk in sliding relationship within the outer sleeve having a proximal end, a distal end, an extended position and a retracted position, the dome-shaped end piece being affixed to the proximal end of the stalk;

wherein each toy vehicle further comprises a spring located partially within the outer sleeve proximate the distal end of the stalk so as to bias the stalk outwardly from each toy vehicle; and wherein the stationary protruding member of the second toy vehicle engages the retractable member of the first toy vehicle, wherein the retractable member of the first toy vehicle moves to the retracted position by force of a user, and the stationary protruding member of the second toy vehicle is releasably retained at least partially within the outer sleeve of the first toy vehicle by a biasing force of the plurality of resilient fingers of the first toy vehicle on the engageable ridge on the stationary protruding member of the second toy vehicle.

7. The magnetic coupling according to claim 1, wherein the retractable member further includes:

an outer sleeve having a plurality of resilient fingers for engagement with the engageable ridge of the stationary member;

a stalk in sliding relationship within the outer sleeve having a shoulder, a proximal end, a distal end, an extended position and a retracted position, the dome-shaped end piece being affixed to the proximal end of the stalk; and a spring located partially within the outer sleeve proximate the distal end of the stalk which biases the stalk in the proximal direction, the spring being retained between the shoulder and a wall of a vehicle.

8. The magnetic coupling according to claim 7, wherein the stationary protruding member engages the retractable member, the retractable member remains in the extended position, and the stationary protruding member remains connected to the retractable member by magnetic attraction.

9. The magnetic coupling according to claim 7, wherein the stationary protruding member engages the retractable member, the retractable member moves to the retracted position by the force of a user, and the stationary protruding member is retained at least partially within the outer sleeve by the biasing force of the plurality of resilient fingers on the engageable ridge.

10. A coupling device for a toy vehicle, the coupling device comprising:

a stationary protruding member having a circumferentially extending engageable ridge and a free end with a first end piece; and a retractable member having a second end piece configured to releasably engage with the first end piece of the stationary protruding member, the retractable member including:

an outer sleeve with a central bore sized to receive the free end of the stationary protruding member and a plurality of resilient fingers to releasably engage with the engageable ridge of the stationary member;

a stalk in the central bore in sliding relationship within the outer sleeve, the stalk having a shoulder, a proximal end, a distal end, an extended position and a retracted position, the second end piece being located at the proximal end of the stalk; and a spring located at least partially within the outer sleeve proximate the distal end of the stalk so as to bias the stalk outwardly.

11. The coupling device according to claim 10 in combination with:

a first toy vehicle having a first end and a second opposing end; and wherein the engageable ridge of the stationary member is located proximate the first end of the vehicle and the retractable member is located proximate the second end of the vehicle.

12. A combination of a first toy vehicle and a second toy vehicle, each toy vehicle having a coupling device comprising:

a stationary protruding member having a circumferentially extending engageable ridge and a free end with a first end piece, the engageable ridge being located proximal a first end of the toy vehicle; and a retractable member having a second end piece configured to releasably engage with the first end piece of the stationary protruding member, the retractable member being located proximal a second, opposing end of the toy vehicle and the retractable member including:

an outer sleeve with a central bore sized to receive the free end of the stationary protruding member and a plurality of resilient fingers to releasably engage with the engageable ridge of the stationary member;

a stalk in the central bore in sliding relationship within the outer sleeve, the stalk having a shoulder, a proximal end, a distal end, an extended position and a retracted position, the second end piece being located at the proximal end of the stalk; and a spring located at least partially within the outer sleeve proximate the distal end of the stalk so as to bias the stalk outwardly, and, wherein when the stationary protruding member of the second toy vehicle engages the retractable member of the first toy vehicle, the retractable member of the first toy vehicle remains in the extended position, and the stationary protruding member of the second toy vehicle remains releasably connected to the retractable member of the first toy vehicle by mechanical engagement.

13. The combination according to claim 12, wherein the mechanical engagement force is sufficiently strong to allow the first toy vehicle to be pulled during play by a user without releasing the second toy vehicle and the mechanical engagement force is sufficiently limited to allow the user to separate the first toy vehicle from the second toy vehicle with more force.

14. The combination according to claim 12, wherein when the stationary protruding member of the second toy vehicle engages the retractable member of the first toy vehicle, the retractable member of the first toy vehicle moves to the retracted position by the force of a user, and the stationary protruding member of the second toy vehicle is releasably retained at least partially within the outer sleeve of the first toy vehicle by the biasing force of the plurality of resilient fingers of the first toy vehicle on an engageable ridge on the stationary protruding member of the second toy vehicle.

15. The coupling device according to claim 10, wherein the stationary protruding member engages the retractable member, the retractable member remains in the extended position, and the stationary protruding member remains connected to the retractable member by engagement of the first and second end-pieces.

16. The coupling device according to claim 10, wherein the stationary protruding member engages the retractable member, the retractable member moves to the retracted position by the force of a user, and the stationary protruding member is retained at least partially within the outer sleeve by the biasing force of the plurality of resilient fingers on the engageable ridge.

17. The coupling device according to claim 10, wherein one of the first end-piece and the second end-piece is a ball and the other of the first end-piece and the second end-piece is a socket.

* * * * *